US011172739B1

(12) United States Patent
Corrigan

(10) Patent No.: US 11,172,739 B1
(45) Date of Patent: Nov. 16, 2021

(54) ROLLING CANE

(71) Applicant: Jean Marie Corrigan, Catasauqua, PA (US)

(72) Inventor: Jean Marie Corrigan, Catasauqua, PA (US)

( * ) Notice: Subject to any disclaimer, the term of this patent is extended or adjusted under 35 U.S.C. 154(b) by 0 days.

(21) Appl. No.: 17/020,925

(22) Filed: Sep. 15, 2020

(51) Int. Cl.

| | |
|---|---|
| ***A45B 3/04*** | (2006.01) |
| ***A45B 1/02*** | (2006.01) |
| ***A45B 3/00*** | (2006.01) |
| ***A45B 9/04*** | (2006.01) |
| ***A61H 3/04*** | (2006.01) |
| *A45B 9/00* | (2006.01) |

(52) U.S. Cl.
CPC ..... *A45B 3/00* (2013.01); *A45B 1/02* (2013.01); *A45B 9/04* (2013.01); *A61H 3/04* (2013.01); *A45B 2009/002* (2013.01)

(58) Field of Classification Search
CPC ..... A45B 9/04; A45B 1/02
See application file for complete search history.

(56) References Cited

U.S. PATENT DOCUMENTS

| | | | | | |
|---|---|---|---|---|---|
| 2,379,426 | A | | 7/1945 | Edstrom | |
| 2,811,978 | A | * | 11/1957 | Russell | A61H 3/00 135/65 |
| 4,962,781 | A | * | 10/1990 | Kanbar | A45B 1/02 135/65 |
| 4,997,001 | A | * | 3/1991 | DiCarlo | A45B 9/04 135/65 |
| 5,533,536 | A | * | 7/1996 | Hong | A61H 3/02 135/65 |
| 5,692,533 | A | * | 12/1997 | Meltzer | A61H 3/04 135/65 |
| 6,158,453 | A | * | 12/2000 | Nasco | A45B 1/02 135/77 |
| 6,715,794 | B2 | | 4/2004 | Frank | |
| 7,261,114 | B2 | * | 8/2007 | Karasin | A61H 3/00 135/85 |
| 7,673,641 | B2 | * | 3/2010 | Karasin | A61H 3/00 135/85 |
| 7,992,584 | B1 | * | 8/2011 | Birnbaum | A61H 3/04 135/67 |
| 8,978,677 | B2 | | 3/2015 | Roberts | |

(Continued)

FOREIGN PATENT DOCUMENTS

WO WO-2013147382 A1 * 10/2013 ..... A45B 1/02

*Primary Examiner* — Noah Chandler Hawk
(74) *Attorney, Agent, or Firm* — Kyle A. Fletcher, Esq.

(57) ABSTRACT

The rolling stick is a supporting structure. The rolling stick transfers the load of a patient to a supporting surface. The rolling stick is a rolling structure. The rolling stick operates in a rolling mode and a stationary mode. The rolling stick includes a stanchion structure, a plurality of leg structures, and a caster structure. The plurality of leg structures and the caster structure attach to the stanchion structure. The stanchion structure transfers the load of the patient to the supporting surface. The caster structure rolls the rolling stick across the supporting surface. The plurality of leg structures forms a mechanical structure that: a) forms multiple load paths used for transferring the load of the patient to the supporting surface; and, b) stabilizes the rolling stick from rolling when the rolling stick is in the stationary mode.

18 Claims, 4 Drawing Sheets

(56) References Cited

U.S. PATENT DOCUMENTS

| | | | | |
|---|---|---|---|---|
| 9,016,297 | B2 * | 4/2015 | Salomon | A45B 1/02 135/66 |
| 10,098,807 | B1 | 10/2018 | Terrell | |
| 10,188,183 | B1 | 1/2019 | Swerdlow | |
| 2004/0216776 | A1 * | 11/2004 | Otis | A61H 3/04 135/85 |
| 2010/0018511 | A1 | 1/2010 | Lendvay | |

* cited by examiner

ROLLING CANE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of traveling articles including walking sticks, more specifically, a detail of a walking stick. (A45B9/00)

SUMMARY OF INVENTION

The rolling stick is a mobility assistance device. The rolling stick is adapted for use with a patient. The rolling stick is a supporting structure. The rolling stick forms a load path that transfers the load of the patient to a supporting surface. The rolling stick is a rolling structure. The rolling stick operates in a mode selected from the group consisting of a rolling mode and a stationary mode. The rolling stick rolls freely in the rolling mode. The rolling stick is inhibited from rolling in the stationary mode. The rolling stick comprises a stanchion structure, a plurality of leg structures, and a caster structure. The plurality of leg structures and the caster structure attach to the stanchion structure. The stanchion structure forms the load path that transfers the load of the patient to the supporting surface. The caster structure is a rotating structure used to roll the rolling stick across the supporting surface. The plurality of leg structures forms a mechanical structure that: a) forms multiple load paths used for transferring the load of the patient to the supporting surface; and, b) stabilizes the rolling stick from rolling when the rolling stick is in the stationary mode.

These together with additional objects, features and advantages of the rolling stick will be readily apparent to those of ordinary skill in the art upon reading the following detailed description of the presently preferred, but nonetheless illustrative, embodiments when taken in conjunction with the accompanying drawings.

In this respect, before explaining the current embodiments of the rolling stick in detail, it is to be understood that the rolling stick is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rolling stick.

It is therefore important that the claims be regarded as including such equivalent construction insofar as they do not depart from the spirit and scope of the rolling stick. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
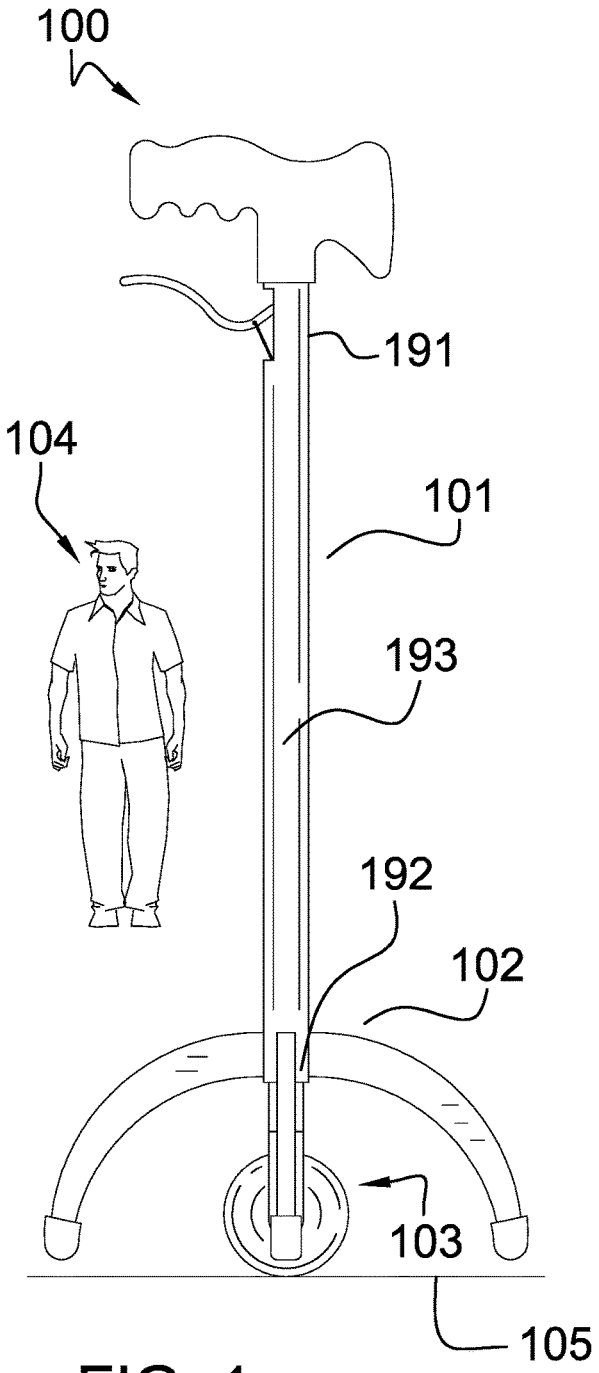
FIG. 1 is a side view of an embodiment of the disclosure.
Figure 2:
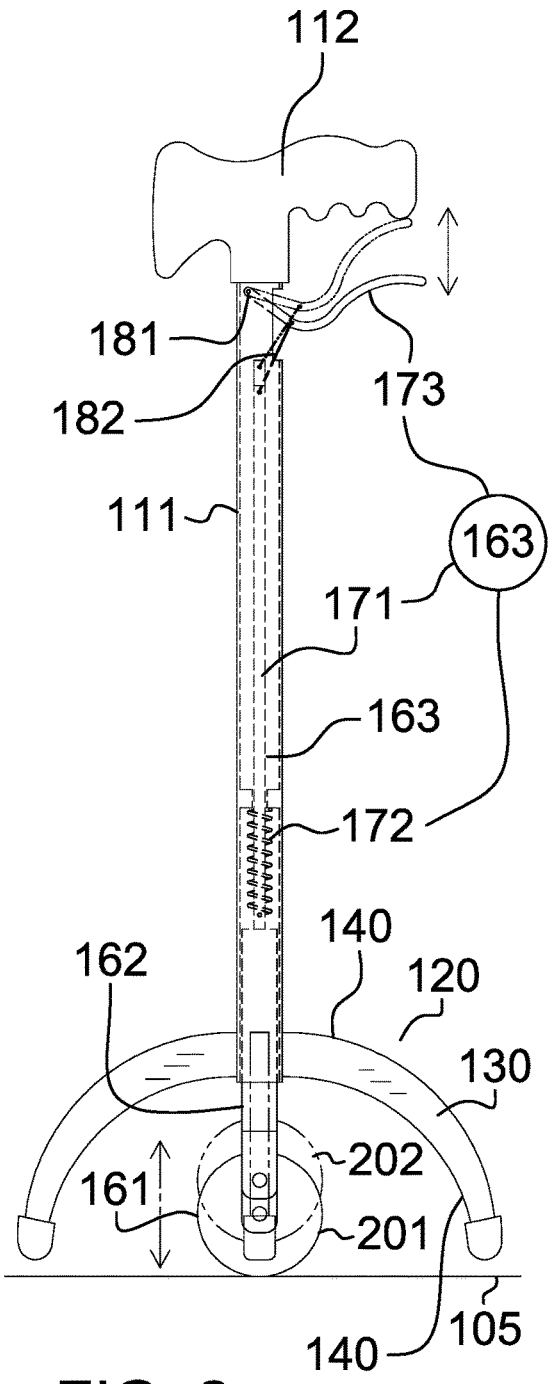
FIG. 2 is a reverse side view of an embodiment of the disclosure.
Figure 3:
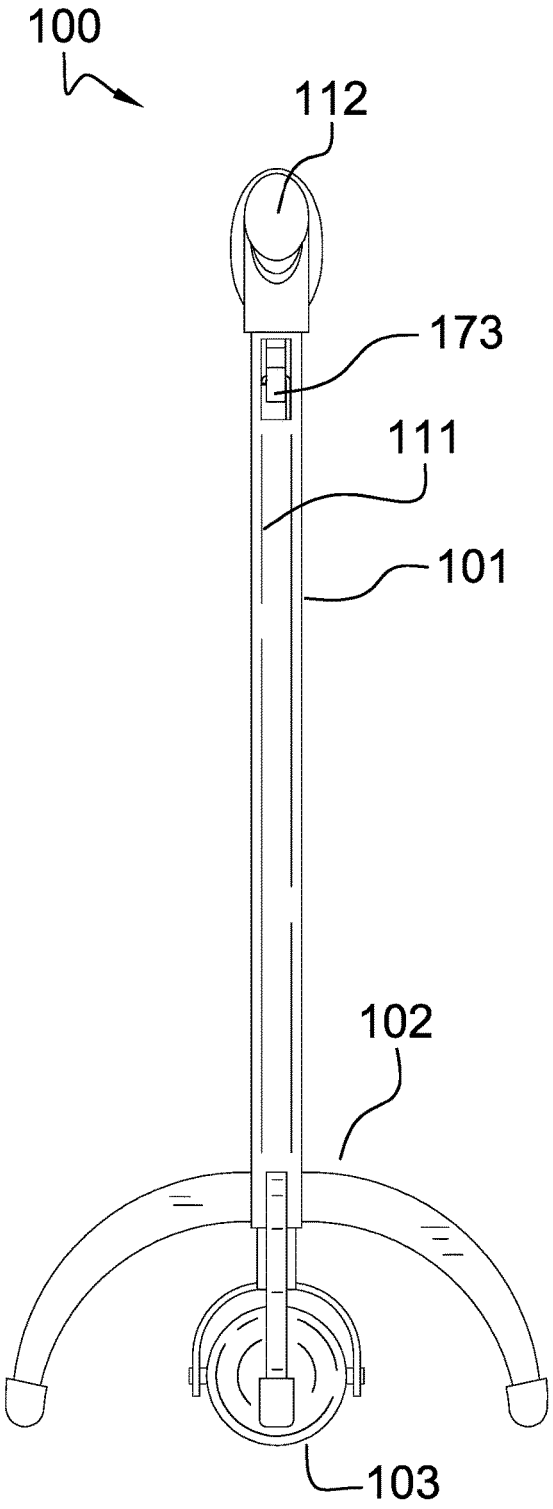
FIG. 3 is a front view of an embodiment of the disclosure.
Figure 4:
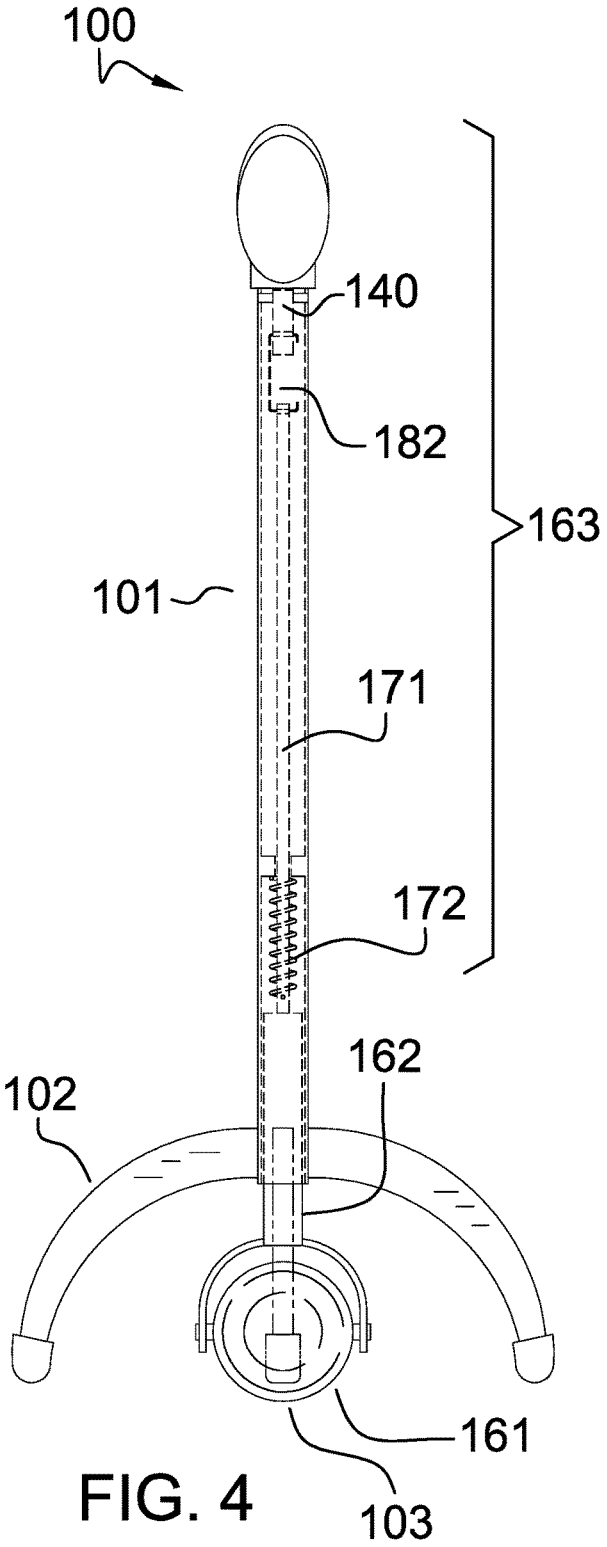
FIG. 4 is a rear view of an embodiment of the disclosure.
Figure 5:
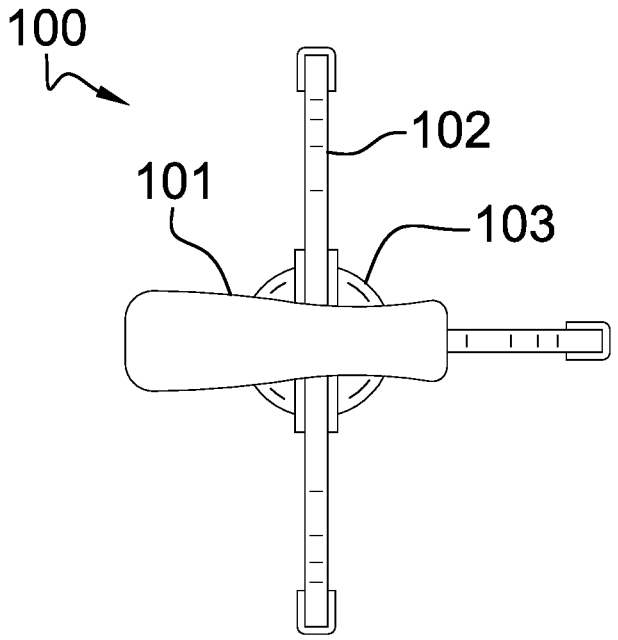
FIG. 5 is a top view of an embodiment of the disclosure.
Figure 6:
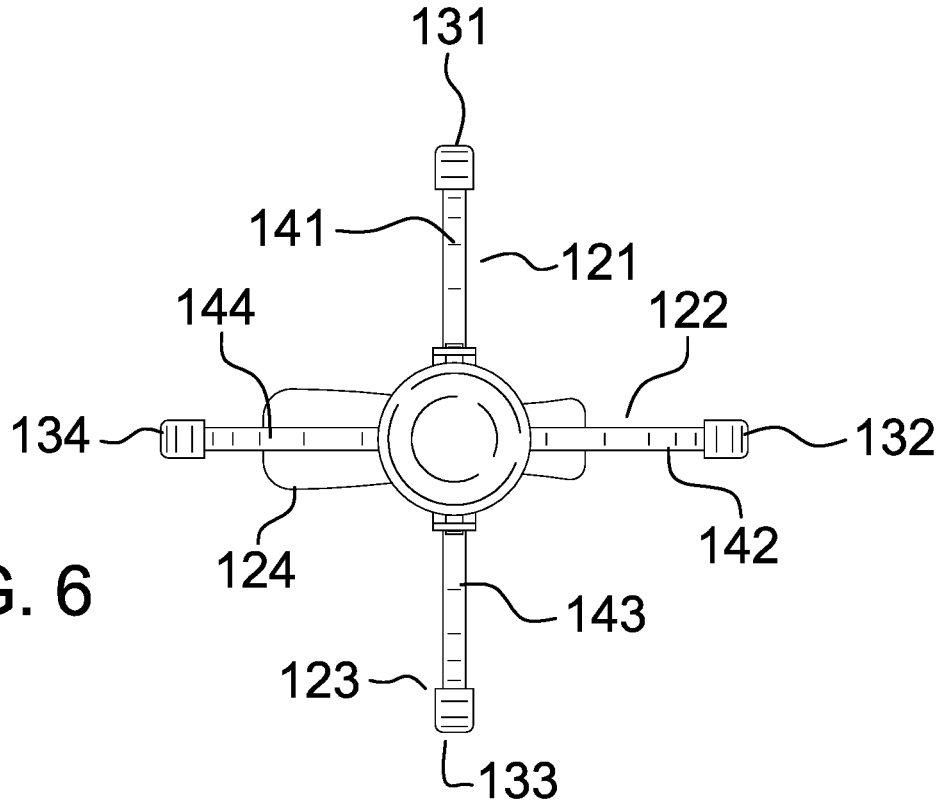
FIG. 6 is a bottom view of an embodiment of the disclosure.
Figure 7:
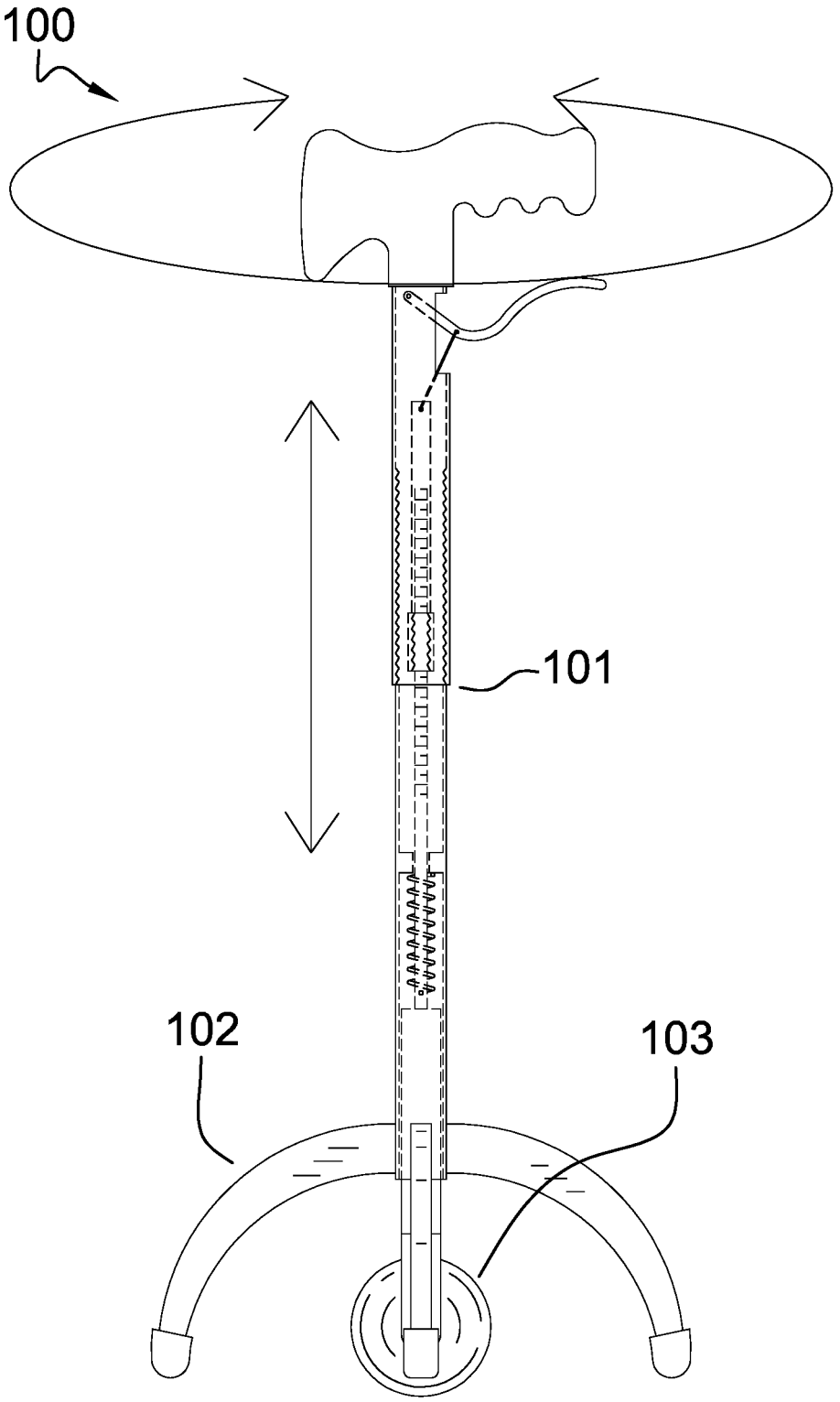
FIG. 7 is a reverse side view of an alternate embodiment of the disclosure.

Detailed reference will now be made to one or more potential embodiments of the disclosure, which are illustrated in FIGS. 1 through 7.

The rolling stick 100 (hereinafter invention) is a balance and mobility assistance device. The invention 100 is adapted for use with a patient 104. The invention 100 is a stanchion 111 structure 101. The invention 100 forms a load path that transfers the load of the patient 104 to a supporting surface 105. The invention 100 is a rolling structure. The invention 100 operates in a mode selected from the group consisting of a rolling mode 201 and a stationary mode 202. The invention 100 rolls freely in the rolling mode 201. The invention 100 is inhibited from rolling in the stationary mode 202. The patient 104 is defined elsewhere in this disclosure. The supporting surface 105 is defined elsewhere in this disclosure.

The invention 100 comprises a stanchion 111 structure 101, a plurality of leg structures 102, and a caster 161 structure 103. The plurality of leg structures 102 and the caster 161 structure 103 attach to the stanchion 111 structure 101. The stanchion 111 structure 101 forms the load path that transfers the load of the patient 104 to the supporting surface 105. The caster 161 structure 103 is a rotating structure used to roll the invention 100 across the supporting surface 105. The plurality of leg structures 102 forms a mechanical structure that: a) forms multiple load paths used for transferring the load of the patient 104 to the supporting surface 105; and, b) stabilizes the invention 100 when the invention 100 is in the stationary mode 202.

The stanchion 111 structure 101 is a prism-shaped structure. The stanchion 111 structure 101 is a vertically oriented structure. The stanchion 111 structure 101 is the structure that receives the load of a patient 104. The stanchion 111 structure 101 forms the load path the transfers the load of the patient 104 to the plurality of leg structures 102 and the caster 161 structure 103. Each of the plurality of leg structures 102 attaches to the stanchion 111 structure 101. The caster 161 structure 103 attaches to the stanchion 111 structure 101. The stanchion 111 structure 101 comprises a stanchion 111 and a grip 112.

The stanchion 111 is a prism-shaped structure. The stanchion 111 is a rigid structure. The stanchion 111 forms the portion of the load path of the invention 100 that receives the load of the patient 104. The stanchion 111 transfers the load received from the patient 104 to the plurality of leg structures 102 and the caster 161 structure 103. The stanchion 111 is a hollow structure. The stanchion 111 comprises a stanchion 111 superior congruent end 191, a stanchion 111 inferior congruent end 192, and a stanchion 111 lateral face 193.

The stanchion 111 superior congruent end 191 is a congruent end of the prism structure of the stanchion 111. The stanchion 111 superior congruent end 191 forms the superior structure of the invention 100. The stanchion 111 inferior congruent end 192 is a congruent end of the prism structure of the stanchion 111. The stanchion 111 inferior congruent end 192 forms the inferior structure of the stanchion 111. The caster 161 used to roll the invention 100 attaches to the stanchion 111 inferior congruent end 192. The stanchion 111 inferior congruent end 192 is the end of the stanchion 111 that is distal from the stanchion 111 superior congruent end 191. The stanchion 111 lateral face 193 is the lateral face of the prism structure of the stanchion 111.

The grip 112 is a prism-shaped structure. The grip 112 is a rigid structure. The grip 112 attaches to the stanchion 111 superior congruent end 191 of the stanchion 111. The grip 112 forms a handle used to carry and manipulate the invention 100.

Each of the plurality of leg structures 102 is a prism-shaped structure. Each of the plurality of leg structures 102 is a disk-shaped structure. Each of the plurality of leg structures 102 forms a brace structure that forms a load path that transfers a portion of the load of the patient 104 to the supporting surface 105. Each of the plurality of leg structures 102 forms a mechanical structure that prevents the caster 161 structure 103 from rolling the invention 100 across the supporting surface 105 when the invention 100 is in the stationary mode 202. The plurality of leg structures 102 combine to form a pedestal that allows the invention 100 to be a self-standing structure when the invention 100 is in the stationary mode 202. The plurality of leg structures 102 comprises a collection of individual legs 120.

Each individual leg 120 selected from the plurality of leg structures 102 is a load bearing structure. Each individual leg 120 forms a portion of the load path formed by the invention 100. Each individual leg 120 projects radially away from the center axis of the stanchion 111. The individual legs 120 are evenly spaced around the stanchion 111. Each individual leg 120 attaches to the stanchion 111 lateral face 193 such that each individual leg 120 forms a portion of the load path formed by the invention 100 when the invention 100 is in the stationary mode 202. Each individual leg 120 stabilizes the stanchion 111 such that a cant does not form between the center axis of the stanchion 111 and the direction of the force of gravity. The individual leg 120 further comprises an individual leg 120 disk structure 130 and an individual leg 120 disk lateral face 140.

The individual leg 120 disk structure 130 is a disk-shaped structure. The individual leg 120 disk structure 130 has a crescent shape. The individual leg 120 disk structure 130 rigidly attaches to the stanchion 111 lateral face 193. The individual leg 120 disk structure 130 attaches to the stanchion 111 lateral face 193 such that the individual leg 120 disk structure 130 forms a portion of the load path formed by the invention 100 when the invention 100 is in the stationary mode 202. Each individual leg 120 disk structure 130 stabilizes the stanchion 111 such that a cant does not form between the center axis of the stanchion 111 and the direction of the force of gravity. Each individual leg 120 disk structure 130 attaches to the stanchion 111 such that the congruent ends of the disk structure of the individual leg 120 disk structure 130 are parallel to the center axis of the stanchion 111.

The individual leg 120 disk lateral face 140 is the lateral face of the disk structure of the individual leg 120 disk structure 130. The individual leg 120 disk lateral face 140 is the surface of the disk structure of the individual leg 120 disk structure 130 that attaches to the stanchion 111 lateral face 193.

The plurality of leg structures 102 further comprises a first leg 121, a second leg 122, a third leg 123, and a fourth leg 124.

The first leg 121 is a first instantiation of the individual leg 120 that is selected from the plurality of leg structures 102. The first leg 121 further comprises a first leg 121 disk structure 131 and a first leg 121 disk lateral face 141. The first leg 121 disk structure 131 is the structure of the first leg 121 that performs the function of the individual leg 120 disk structure 130 of the individual leg 120 for the first leg 121. The first leg 121 disk lateral face 141 is the structure of the first leg 121 that performs the function of the individual leg 120 disk lateral face 140 of the individual leg 120 for the first leg 121.

The second leg 122 is a second instantiation of the individual leg 120 that is selected from the plurality of leg structures 102. The second leg 122 further comprises a second leg 122 disk structure 132 and a second leg 122 disk lateral face 142. The second leg 122 disk structure 132 is the structure of the second leg 122 that performs the function of the individual leg 120 disk structure 130 of the individual leg 120 for the second leg 122. The second leg 122 disk lateral face 142 is the structure of the second leg 122 that performs the function of the individual leg 120 disk lateral face 140 of the individual leg 120 for the second leg 122.

The third leg 123 is a third instantiation of the individual leg 120 that is selected from the plurality of leg structures 102. The third leg 123 further comprises a third leg 123 disk structure 133 and a third leg 123 disk lateral face 143. The third leg 123 disk structure 133 is the structure of the third leg 123 that performs the function of the individual leg 120 disk structure 130 of the individual leg 120 for the third leg 123. The third leg 123 disk lateral face 143 is the structure of the third leg 123 that performs the function of the individual leg 120 disk lateral face 140 of the individual leg 120 for the third leg 123.

The fourth leg 124 is a fourth instantiation of the individual leg 120 that is selected from the plurality of leg structures 102. The fourth leg 124 further comprises a fourth leg 124 disk structure 134 and a fourth leg 124 disk lateral face 144. The fourth leg 124 disk structure 134 is the structure of the fourth leg 124 that performs the function of the individual leg 120 disk structure 130 of the individual leg 120 for the fourth leg 124. The fourth leg 124 disk lateral face 144 is the structure of the fourth leg 124 that performs the function of the individual leg 120 disk lateral face 140 of the individual leg 120 for the fourth leg 124.

The caster 161 structure 103 is a mechanical structure. The caster 161 structure 103 is a rolling structure. The caster 161 structure 103 forms the inferior structure of the invention 100 when the invention 100 is in the rolling mode 201. The rolling portion of the caster 161 structure 103 attaches to the stanchion 111 inferior congruent end 192 of the stanchion 111. The caster 161 structure 103 further forms a mechanical linkage between the caster 161 of the caster 161 structure 103 and the stanchion 111 superior congruent end 191 of the stanchion 111 such that the caster 161 structure 103 can elevate the caster 161 of the caster 161 structure 103 above the supporting surface 105 to put the invention 100 into the stationary mode 202. The caster 161 structure 103 comprises a caster 161, a caster 161 mount 162, and a caster 161 pull 163.

The caster 161 is a rotating structure. The caster 161 is defined elsewhere in this disclosure. The caster 161 forms the inferior structure of the invention 100 when the invention 100 is in the rolling mode 201. The caster 161 rolls the invention 100 over the supporting surface 105 when the invention 100 is in the rolling mode 201.

The caster 161 mount 162 is a mechanical structure. The caster 161 mount 162 attaches the caster 161 to the stanchion 111 inferior congruent end 192 of the prism structure of the stanchion 111. The caster 161 mount 162 inserts into the hollow interior of the stanchion 111 through the stanchion 111 inferior congruent end 192. The caster 161 mount 162 moves within the stanchion 111 in a direction that is parallel to the center axis of the stanchion 111. The movement of the caster 161 mount 162 within the stanchion 111 adjusts the elevation caster 161 above the supporting surface 105. The caster 161 mount 162 draws the caster 161 above the supporting surface 105 such that the entire load of the patient 104 passes through the load paths formed by the plurality of leg structures 102. When the position of the caster 161 is such that the entire load of the patient 104 passes through the load paths formed by the plurality of leg structures 102, the invention 100 is in the stationary mode 202.

The caster 161 pull 163 is a mechanical structure.

The caster 161 pull 163 forms a mechanical linkage between the caster 161 mount 162 and an apparatus, referred to as the pull lever 173, formed at the grip 112 of the stanchion 111. The caster 161 pull 163 mechanically controls the position of the caster 161 mount 162 of the caster 161. The caster 161 pull 163 comprises a pull rod 171, a compression spring 172, and a pull lever 173.

The pull rod 171 is a prism-shaped structure. The pull rod 171 is a rigid structure. The pull rod 171 inserts into the hollow interior of the stanchion 111 such that the pull rod 171 moves within the stanchion 111 to form a composite prism structure. The pull rod 171 moves within the stanchion 111 in a direction that is parallel to the center axis of the prism structure of the stanchion 111. The pull rod 171 attaches to the caster 161 mount 162 such that the motion of the pull rod 171 within the stanchion 111 changes the position of the caster 161 mount 162. The pull rod 171 further attaches to the pull lever 173 such that the rotation of the pull lever 173 adjusts the position of the pull rod 171 relative to the stanchion 111.

The compression spring 172 is a spring. The spring and the compression spring 172 are defined elsewhere in this disclosure. The compression spring 172 attaches the pull rod 171 to an interior structure of the stanchion 111. The compression spring 172 attaches to the pull rod 171 such that the position of the pull rod 171 within the stanchion 111 deforms the compression spring 172 when the pull rod 171 is positioned to put the invention 100 into the stationary mode 202. The return of the compression spring 172 to its relaxed shape will return the invention 100 to the rolling mode 201.

The pull lever 173 is a mechanical structure. The pull lever 173 forms a lever. The pull lever 173 attaches to the grip 112 of the stanchion 111 structure 101 such that the pull lever 173 rotates relative to the grip 112. The pull lever 173 attaches to the pull rod 171 such that the rotation of the pull lever 173 relative to the grip 112 moves the pull rod 171 within the stanchion 111. The pull lever 173 further comprises a pull pivot 181 and a pull wire 182.

The pull pivot 181 is a fastening structure. The pull pivot 181 is a pivot structure that attaches the pull lever 173 to the grip 112 of the stanchion 111 structure 101 such that the pull lever 173 rotates to the grip 112. The pull wire 182 is a cord. The pull wire 182 attaches the pull lever 173 to the pull rod 171 such that the rotational mechanical forces generated by the rotation of the pull lever 173 relative to the grip 112 applies a tension to the pull wire 182 that transfers the rotational mechanical force into a linear force that moves the pull rod 171 within the stanchion 111.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Caster: As used in this disclosure, a caster is a wheel that is mounted on a swivel that allows the wheel to adjust, or swivel, the direction of rotation of the wheel to the direction of motion desired for the wheel. The generic parts of a caster are called the stem, the swivel bearing, the swivel mount, and the wheel. The swivel bearing attaches the stem to the swivel mount such that the swivel mount will rotate relative to the stem. The wheel attaches to the swivel mount such that the wheel freely rotates relative to the swivel mount. The direction of the axis of rotation of the wheel is perpendicular to the direction of the axis of rotation of the swivel mount. The stem attaches the swivel bearing, the swivel mount, and the wheel to an externally provided object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Compression Spring: As used in this disclosure, a compression spring is a wire coil that resists forces attempting to compress the wire coil in the direction of the center axis of the wire coil. The compression spring will return to its relaxed shape when the compressive force is removed.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Crescent: As used in this disclosure, a crescent is a two edged geometric shape formed from the overlapping of a second circle over a first circle. The diameter of the first circle and the diameter of the second circle may or may not be identical. The first circle and the second circle may or may not share a common center point. The crescent is formed by: 1) overlaying the second circle on the first circle such that two points of intersection are formed; 2) using the second circle as a negative space that removes the area and segment of the circumference of the first circle that is contained within the second circle, and 3) replacing the removed circumference of the first circle with the segment of the circumference of the second circle contained within the area of the first circle to form the second edge of the crescent. Within the scope of this definition an ellipse may be substituted for either (or both) of the first circle and the second circle. Further, within the scope of this definition either (or both) of the two intersection points may be rounded, as defined elsewhere in this disclosure.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Instantiation: As used in this disclosure, an instantiation refers to a specific physical object or process that is created using a specification.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Lever: As used in this disclosure, a lever is a device that rotates around a pivot point commonly referred to as a shaft.

Mechanical Linkage: As used in this disclosure, a mechanical linkage is an interconnected arrangement of components that are used to manage the transfer of a movement or a force. A mechanical linkage is often referred to as a linkage.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Patient: As used in this disclosure, a patient is a person who is designated to receive a medical treatment, therapy, or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force. See bimodal flexible structure.

Roll: As used in this disclosure, the term roll refers to the motion of an object that is facilitated by the rotation of one or more wheels or a casters.

Self-Standing: As used in this disclosure, self-standing refers to a mechanical structure that: a) remains stable on a supporting surface; without, b) requiring the transfer of a portion of the load of the mechanical structure to load paths provided by structures that are independent of the mechanical structure.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Swivel: As used in this disclosure, a swivel is a fastening structure that attaches a first object to a second object such that will rotate around an axis of rotation while the second object remains in a fixed position relative to the first object.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

Wire: As used in this disclosure, a wire is a structure with the general appearance of a cord or strand but that: 1) may not have the tensile or compressive characteristics of a cord; and, 2) is made from an electrically conductive material.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rolling stick comprising a stanchion structure, a plurality of leg structures, and a caster structure;

wherein the plurality of leg structures and the caster structure attach to the stanchion structure;

wherein the rolling stick is a mobility assistance device;

wherein the rolling stick is adapted for use with a patient;

wherein the rolling stick is a supporting structure;

wherein the rolling stick forms a load path that transfers the load of the patient to a supporting surface;

wherein the rolling stick is a rolling structure;

wherein the rolling stick operates in a mode selected from the group consisting of a rolling mode and a stationary mode;

wherein the rolling stick rolls freely in the rolling mode;

wherein the rolling stick is inhibited from rolling in the stationary mode;

wherein the plurality of leg structures comprises a collection of individual legs;

wherein each individual leg selected from the plurality of leg structures is a load bearing structure;

wherein each individual leg forms a portion of the load path formed by the rolling stick;

wherein each individual leg projects radially away from the center axis of the stanchion;

wherein the individual leg further comprises an individual leg disk structure and an individual leg disk lateral face;

wherein the individual leg disk structure is a disk-shaped structure;

wherein the individual leg disk structure has a crescent shape;

wherein the individual leg disk structure rigidly attaches to the stanchion lateral face;

wherein the individual leg disk structure attaches to the stanchion lateral face such that the individual leg disk structure forms a portion of the load path formed by the rolling stick when the rolling stick is in the stationary mode;

wherein each individual leg disk structure stabilizes the stanchion such that a cant does not form between the center axis of the stanchion and the direction of the force of gravity;

wherein each individual leg disk structure attaches to the stanchion such that the congruent ends of the disk structure of the individual leg disk structure are parallel to the center axis of the stanchion;

wherein the individual leg disk lateral face is the lateral face of the disk structure of the individual leg disk structure;

wherein the individual leg disk lateral face is the surface of the disk structure of the individual leg disk structure that attaches to the stanchion lateral face.

2. The rolling stick according to claim 1 wherein the stanchion structure forms the load path that transfers the load of the patient to the supporting surface;

wherein the caster structure is a rotating structure used to roll the rolling stick across the supporting surface;

wherein the plurality of leg structures forms a mechanical structure that: a) forms multiple load paths used for transferring the load of the patient to the supporting surface; and, b) stabilizes the rolling stick when the rolling stick is in the stationary mode.

3. The rolling stick according to claim 2 wherein the stanchion structure is a prism-shaped structure;

wherein the stanchion structure is a vertically oriented structure;

wherein the stanchion structure is the structure that receives the load of a patient;

wherein the stanchion structure forms the load path the transfers the load of the patient to the plurality of leg structures and the caster structure.

4. The rolling stick according to claim 3 wherein each of the plurality of leg structures is a prism-shaped structure;

wherein each of the plurality of leg structures is a disk-shaped structure;

wherein each of the plurality of leg structures forms a brace structure that forms a load path that transfers a portion of the load of the patient to the supporting surface.

5. The rolling stick according to claim 4 wherein each of the plurality of leg structures forms a mechanical structure that prevents the caster structure from rolling the rolling stick across the supporting surface when the rolling stick is in the stationary mode;

wherein the plurality of leg structures combine to form a pedestal that allows the rolling stick to be a self-standing structure when the rolling stick is in the stationary mode.

6. The rolling stick according to claim 5 wherein the individual legs of the plurality of leg structures are evenly spaced around the stanchion;

wherein each individual leg attaches to the stanchion lateral face such that each individual leg forms a portion of the load path formed by the rolling stick when the rolling stick is in the stationary mode;

wherein each individual leg stabilizes the stanchion such that a cant does not form between the center axis of the stanchion and the direction of the force of gravity.

7. The rolling stick according to claim 6 wherein the caster structure is a mechanical structure;

wherein the caster structure is a rolling structure;

wherein the caster structure forms the inferior structure of the rolling stick when the rolling stick is in the rolling mode;

wherein the rolling portion of the caster structure attaches to a stanchion inferior congruent end of the stanchion.

8. The rolling stick according to claim 7 wherein the stanchion structure comprises a stanchion and a grip;

wherein the grip attaches to the stanchion.

9. The rolling stick according to claim 8 wherein the caster structure comprises a caster, a caster mount, and a caster pull;

wherein the caster forms the inferior structure of the rolling stick when the rolling stick is in the rolling mode;

wherein the caster mount attaches the caster to the stanchion;

wherein the caster pull forms a mechanical linkage that moves the caster mount within the stanchion.

10. The rolling stick according to claim 9 wherein the caster structure further forms a mechanical linkage between the caster of the caster structure and a stanchion superior congruent end of the stanchion such that the caster structure can elevate the caster of the caster structure above the supporting surface to put the rolling stick into the stationary mode.

11. The rolling stick according to claim 10
wherein the stanchion is a prism-shaped structure;
wherein the stanchion is a rigid structure;
wherein the stanchion forms the portion of the load path of the rolling stick that receives the load of the patient;
wherein the stanchion transfers the load received from the patient to the plurality of leg structures and the caster structure;
wherein the stanchion is a hollow structure.

12. The rolling stick according to claim 11
wherein the grip is a prism-shaped structure;
wherein the grip is a rigid structure;
wherein the grip attaches to the stanchion superior congruent end of the stanchion;
wherein the grip forms a handle used to carry and manipulate the rolling stick.

13. The rolling stick according to claim 12
wherein the stanchion comprises the stanchion superior congruent end, the stanchion inferior congruent end, and a stanchion lateral face;
wherein the stanchion superior congruent end is a congruent end of the prism structure of the stanchion;
wherein the stanchion superior congruent end forms the superior structure of the rolling stick;
wherein the stanchion inferior congruent end is a congruent end of the prism structure of the stanchion;
wherein the stanchion inferior congruent end forms the inferior structure of the stanchion;
wherein the caster used to roll the rolling stick attaches to the stanchion inferior congruent end;
wherein the stanchion inferior congruent end is the end of the stanchion that is distal from the stanchion superior congruent end;
wherein the stanchion lateral face is the lateral face of the prism structure of the stanchion.

14. The rolling stick according to claim 13
wherein the caster is a rotating structure;
wherein the caster rolls the rolling stick over the supporting surface when the rolling stick is in the rolling mode;
wherein the caster mount attaches the caster to the stanchion inferior congruent end of the prism structure of the stanchion;
wherein the caster mount inserts into the hollow interior of the stanchion through the stanchion inferior congruent end;
wherein the caster mount moves within the stanchion in a direction that is parallel to the center axis of the stanchion;
wherein the movement of the caster mount within the stanchion adjusts the elevation caster above the supporting surface;
wherein the caster mount draws the caster above the supporting surface such that the entire load of the patient passes through the load paths formed by the plurality of leg structures;
wherein the position of the caster is such that the entire load of the patient passes through the load paths formed by the plurality of leg structures when the rolling stick is in the stationary mode.

15. The rolling stick according to claim 14
wherein the caster pull is a mechanical structure;
wherein the caster pull forms a mechanical linkage between the caster mount and an apparatus, referred to as the pull lever, formed at the grip of the stanchion;
wherein the caster pull mechanically controls the position of the caster mount of the caster.

16. The rolling stick according to claim 15
wherein the caster pull comprises a pull rod, a compression spring, and a pull lever;
wherein the pull rod is a prism-shaped structure;
wherein the pull rod is a rigid structure;
wherein the pull rod inserts into the hollow interior of the stanchion such that the pull rod moves within the stanchion to form a composite prism structure;
wherein the pull rod moves within the stanchion in a direction that is parallel to the center axis of the prism structure of the stanchion;
wherein the pull rod attaches to the caster mount such that the motion of the pull rod within the stanchion changes the position of the caster mount;
wherein the pull rod further attaches to the pull lever such that the rotation of the pull lever adjusts the position of the pull rod relative to the stanchion.

17. The rolling stick according to claim 16
wherein the compression spring is a spring;
wherein the compression spring attaches the pull rod to an interior structure of the stanchion;
wherein the compression spring attaches to the pull rod such that the position of the pull rod within the stanchion deforms the compression spring when the pull rod is positioned to put the rolling stick into the stationary mode;
wherein the return of the compression spring to its relaxed shape will return the rolling stick to the rolling mode;
wherein the pull lever is a mechanical structure;
wherein the pull lever forms a lever;
wherein the pull lever attaches to the grip of the stanchion structure such that the pull lever rotates relative to the grip;
wherein the pull lever attaches to the pull rod such that the rotation of the pull lever relative to the grip moves the pull rod within the stanchion;
wherein the pull lever further comprises a pull pivot and a pull wire;
wherein the pull pivot is a fastening structure;
wherein the pull pivot is a pivot structure that attaches the pull lever to the grip of the stanchion structure such that the pull lever rotates to the grip;
wherein the pull wire is a cord;
wherein the pull wire attaches the pull lever to the pull rod such that the rotational mechanical forces generated by the rotation of the pull lever relative to the grip applies a tension to the pull wire that transfers the rotational mechanical force into a linear force that moves the pull rod within the stanchion.

18. The rolling stick according to claim 17
wherein the plurality of leg structures further comprises a first leg, a second leg, a third leg, and a fourth leg;
wherein the first leg is a first instantiation of the individual leg that is selected from the plurality of leg structures;
wherein the first leg further comprises a first leg disk structure and a first leg disk lateral face;
wherein the first leg disk structure is the structure of the first leg that performs the function of the individual leg disk structure of the individual leg for the first leg;
wherein the first leg disk lateral face is the structure of the first leg that performs the function of the individual leg disk lateral face of the individual leg for the first leg;
wherein the second leg is a second instantiation of the individual leg that is selected from the plurality of leg structures;

wherein the second leg further comprises a second leg disk structure and a second leg disk lateral face;

wherein the second leg disk structure is the structure of the second leg that performs the function of the individual leg disk structure of the individual leg for the second leg;

wherein the second leg disk lateral face is the structure of the second leg that performs the function of the individual leg disk lateral face of the individual leg for the second leg;

wherein the third leg is a third instantiation of the individual leg that is selected from the plurality of leg structures;

wherein the third leg further comprises a third leg disk structure and a third leg disk lateral face;

wherein the third leg disk structure is the structure of the third leg that performs the function of the individual leg disk structure of the individual leg for the third leg;

wherein the third leg disk lateral face is the structure of the third leg that performs the function of the individual leg disk lateral face of the individual leg for the third leg;

wherein the fourth leg is a fourth instantiation of the individual leg that is selected from the plurality of leg structures;

wherein the fourth leg further comprises a fourth leg disk structure and a fourth leg disk lateral face;

wherein the fourth leg disk structure is the structure of the fourth leg that performs the function of the individual leg disk structure of the individual leg for the fourth leg;

wherein the fourth leg disk lateral face is the structure of the fourth leg that performs the function of the individual leg disk lateral face of the individual leg for the fourth leg.

* * * * *